US006011325A

United States Patent [19]

Goldberg et al.

[11] Patent Number: 6,011,325

[45] Date of Patent: Jan. 4, 2000

[54] ROTARY SWITCH WITH REDUNDANT CONTACTS

[75] Inventors: Joshua I. Goldberg, Woodbridge; Kenneth D. Milkie, Vernon, both of Conn.

[73] Assignee: United Technologies Corporation, Windsor Locks, Conn.

[21] Appl. No.: 09/064,540

[22] Filed: Apr. 22, 1998

[51] Int. Cl.[7] ..... H01H 35/00

[52] U.S. Cl. ..... 307/119; 200/37 R; 200/38 C

[58] Field of Search ..... 307/119, 120, 307/116, 115; 200/11 G, 11 R, 11 TW, 19.01, 19.06, 19.07, 19.12, 19.18, 33 R, 35 R, 36, 37 R, 38 C

[56] References Cited

U.S. PATENT DOCUMENTS 4,144,930 3/1979 Ferdelman ..... 165/12
4,292,502 9/1981 Adams ..... 219/483
4,346,269 8/1982 Slavin et al. ..... 200/11
4,493,954 1/1985 Kimmel et al. ..... 200/11
4,581,500 4/1986 Henderson et al. ..... 200/11

*Primary Examiner*—Jeffrey Gaffin
*Assistant Examiner*—Peter Zura

[57] ABSTRACT

A rotary switch for providing deicing power to the heaters of a helicopter rotor includes a conductive rotor with conductive protrusions located thereon. Conductive fingers are arranged such that a pair of conductive fingers are in electrical communication with a pair of conductive protrusions for a given position of the conductive rotor. The pair of conductive fingers are in electrical communication with the heaters of a helicopter rotor such that if one the pair of electrical fingers fails to make electrical contact with its respective conductive protrusion electrical power is still delivered to the heater.

9 Claims, 3 Drawing Sheets

FIG. 1
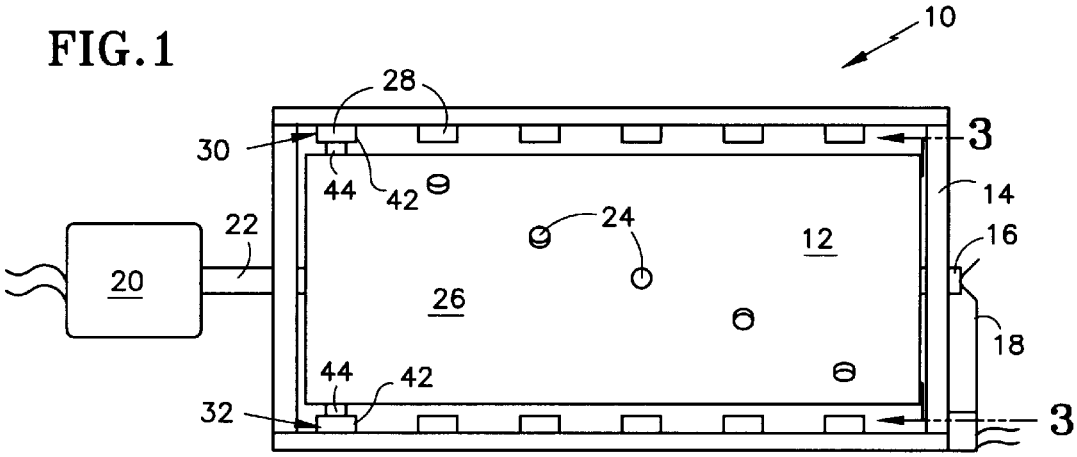
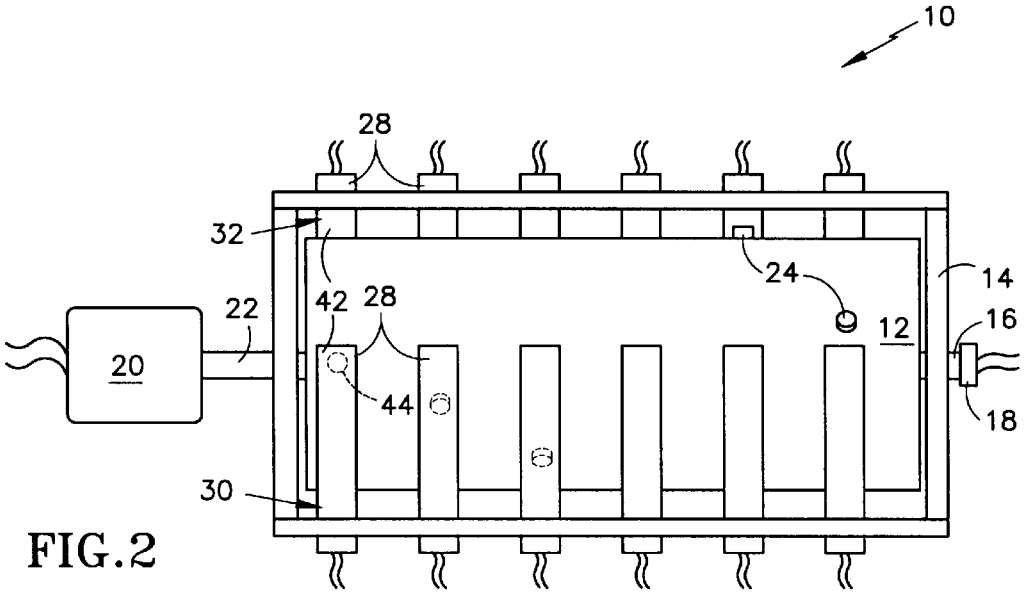
FIG. 2

FIG.3
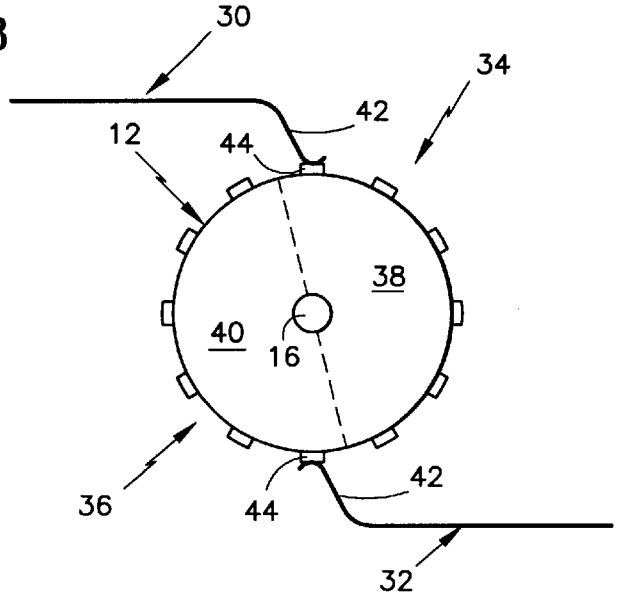
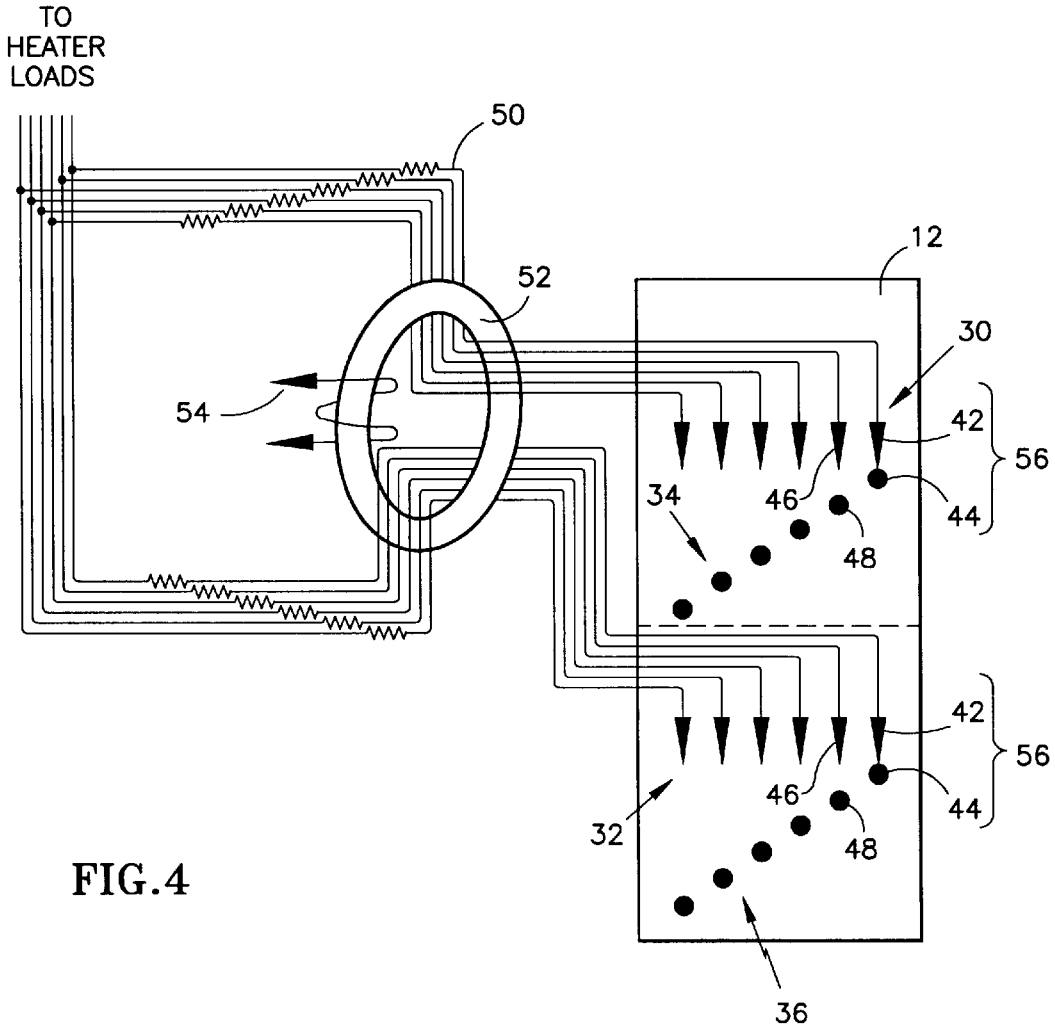
FIG.4

FIG.5
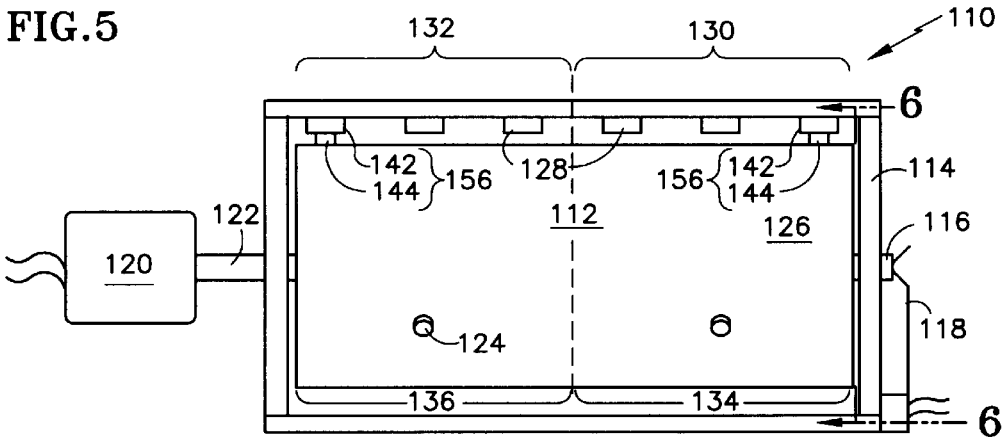
FIG.6
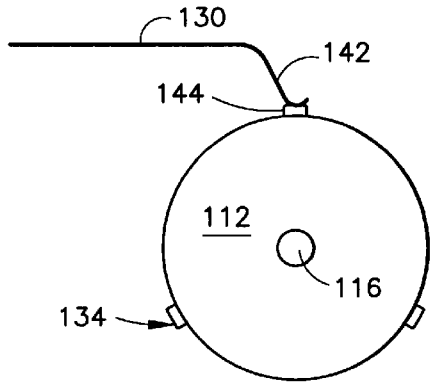
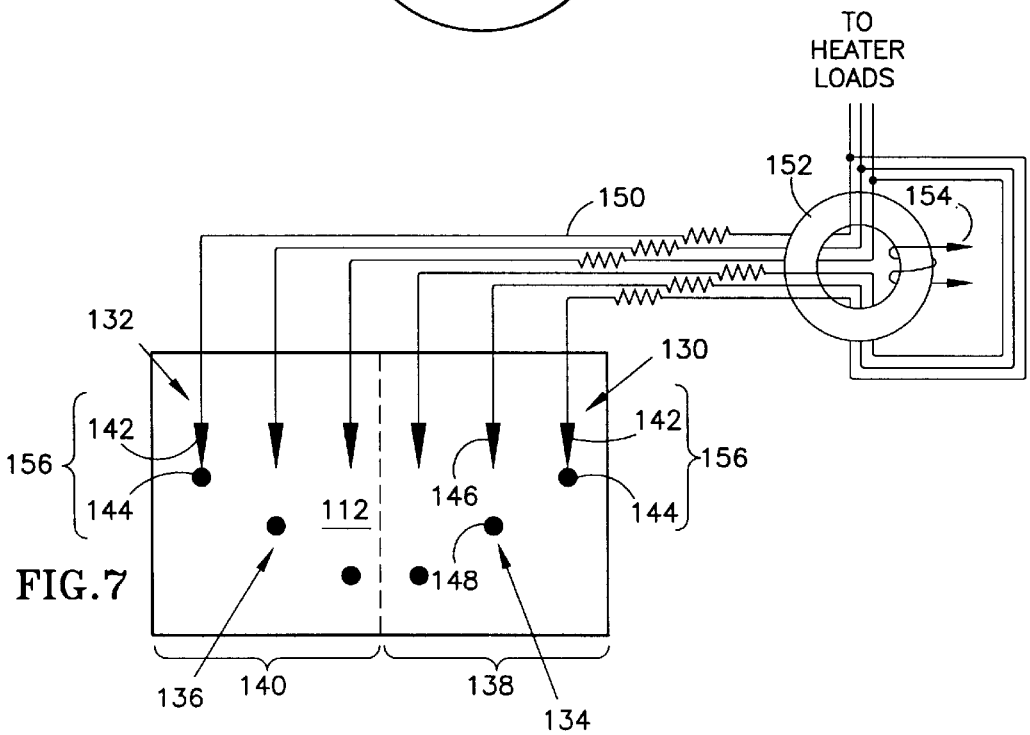
FIG.7

ROTARY SWITCH WITH REDUNDANT CONTACTS

DESCRIPTION

1. Technical Field

This invention relates to rotary electrical switches and more particularly to high reliability rotary electrical switches with redundant electrical contacts.

2. Background Art

To reduce the risk of failure due to ice build up, helicopter rotors employ heater circuits on the leading edge of the propeller rotors to melt the bond between any ice that may form thereon. The rotors have large surface areas to be deiced and therefore the power must be applied sequentially to various areas of the rotor to prevent excessive power draw. The sequential control of power is provided by a rotary switch.

Maintaining the rotors in an ice free condition is critical to flight safety. Therefore the rotary switch must be highly reliable. The switch must also be capable of either performing its function or providing a warning that the function is not available.

The prior art uses a rotary stepper switch having a conducting rotary portion in electrical communication with deicing power. Raised conducting portions are located on the surface of the rotary portion which make contact with metal conducting fingers. The conducting fingers are arranged to make contact with the raised portions only, as the rotary portion is stepped through the various positions. The fingers are in electrical communication with the heaters located on the helicopter rotor. Thus, as the rotary switch is stepped through the various positions, power is supplied to the different heaters of the rotor.

One prevalent failure mode of the rotary switch is a failure of the fingers to make contact with the raised portions when advanced due to mechanical wear of the raised portion and/or finger. This failure results in loss of deicing capability for the heater associated with that finger leading to dangerous ice build up on the rotor.

DISCLOSURE OF INVENTION

According to the present invention, a rotary switch comprises a conductive rotor which receives power via a conductive metal finger or brush contact preloaded to make contact with the conductive rotor as the rotor is stepped through various positions. Located on the surface of the rotor are raised conductive portions. Conductive fingers are arranged relative to the rotor and raised portions such that as the rotor is stepped through the various positions, the raised portions will come into contact with the metal fingers thus providing power to the metal fingers which are in turn connected to the heaters of the helicopter for deicing.

The raised portions and conductive fingers define the electrical contacts for the rotary switch. There are two such contacts for each step of the rotor and associated heater, forming a redundant pair. Therefore if one contact fails, the other contact still provides power to the heater.

The contacts are further arranged such that a first contact of the redundant pair provides current to a current transformer with the current having current flow in a first direction. The second contact of the redundant pair provides current to the current transformer with the current flow in a direction opposite the first current flow such that when both contacts are functioning properly, the output of the current transformer is zero. If either contact fails, the current transformer provides a current signal indicative of a contact failure.

BRIEF DESCRIPTION OF DRAWINGS

FIG. 1 is planar view of the rotary switch with angularly diverse fingers for deicing six zones;

FIG. 2 is a top view of the rotary switch of FIG. 1;

FIG. 3 is a view of the rotary switch of FIG. 1 taken along line 3—3;

FIG. 4 is an electrical schematic of the rotary switch of FIG. 1;

FIG. 5 is schematic view of the rotary switch with longitudinally diverse fingers for deicing three zones;

FIG. 6 is a view of the rotary switch of FIG. 5 taken along line 5—5; and FIG. 7 is an electrical schematic of the rotary switch of FIG. 5.

BEST MODE FOR CARRY OUT THE INVENTION

Referring to FIGS. 1, 2 and 3 there is illustrated a rotary switch 10 incorporating angularly offset fingers 28 according to a first embodiment of the present invention. The rotary switch 10 consists of a conductive rotor 12 supported by a conductive shaft 16 within a frame 14 for rotation therein. A conductive finger 18 is preloaded to remain in contact with the conductive shaft 16. The conductive rotor 12 must be insulated from ground. This may be accomplished by manufacturing the frame 14 or portions thereof from an insulating material or by providing a non-conductive surface between the conductive shaft 16 and the frame 14. The conductive finger 18 is in electrical communication with a deicing power source (not shown), thus providing power to the conductive rotor 12 as it rotates. A stepper motor 20 is connected to an opposite end 22 of conductive shaft 16 for positioning the conductive rotor 12. Other means 20 of positioning the conductive rotor 12 may also be used, such as a solenoid and gear arrangement. Care must be taken to electrically isolate the conductive shaft 16 from the means for positioning the conductive rotor 20 such as forming the gear from an insulating material or covering the end of the shaft 16 with an insulating material at the interface of the shaft and means for positioning 20.

Conductive protrusions 24 are located on an outer surface 26 of conductive rotor 12. Conductive fingers 28 are positioned relative to the conductive protrusions 24 and the conductive rotor 12 by frame 14 such that a conductive finger 28 makes electrical contact with a conductive protrusion 24 when a protrusion 24 is located proximate a finger 28. Power is provided to a heater of a helicopter rotor (not shown) when the conductive finger 28 is in electrical contact with the conductive protrusion 24.

The rotary switch 10 as illustrated in FIGS. 1, 2 and 3 provides power to six heater zones for a helicopter rotor. The conductive fingers 28 are arranged in two redundant banks, a first bank 30 and a second bank 32 along opposing sides of frame 14. As illustrated the each bank 30 and 32 contains six conductive fingers 28. The conductive fingers 28 are further arranged such that a finger 28 from first bank 30 is circumferentially aligned, relative to conductive rotor 12, with a finger 28 of second bank 32, thus defining six pairs of circumferentially aligned fingers 28.

The conductive protrusions are likewise arranged in two redundant banks, a first set 34 and a second set 36, as illustrated in FIG. 3, with first set 34 located on a first 180° section 38 of conductive rotor 12 and second set 36 located on a second 180° section 40 of rotor 12.

The conductive protrusion are located every 30° around the circumference of the conductive rotor 12 for a total of 12 conductive protrusions. The conductive protrusions 12 are further arranged such that there are two protrusions circumferentially aligned with each set fingers 42. These aligned protrusions are offset from each other by 180°. Therefore, with the conductive rotor 12 in a first position as shown in FIGS. 1, 2 and 3, conductive fingers 42 make electrical contact with conductive protrusions 44 thus providing power to a first heater of a helicopter rotor through two redundant contacts.

The electrical schematic of the subject invention according to the first embodiment is depicted in FIG. 4. The conductive rotor 12 is shown with first bank of conductive fingers 30 and a first set of conductive protrusions 36, a second bank of conductive fingers 32 and a second set of conductive protrusions 34. A pair of conductive fingers 42 is shown in contact with a pair of conductive protrusions 44, thus providing power to a heater. As the conductive rotor rotates a second pair of conductive fingers 46 will make contact with a second pair of conductive protrusions 48. Each pair of conductive fingers 42 is connected to a respective heater by equivalent resistance wire 50. The wire 50 is connected to the heater via a current transformer 52. The wire 50 from each finger 28 of the pair of fingers 42 is connected to the current transformer 52 such that when current is present in each wire 50, the current output 54 is zero. If either finger 28 of a pair of fingers 42 fails to make contact with their respective conductive protrusion 44 the current output 54 will no longer be zero, indicating a failure of one of the redundant pair of contacts 56. The direction of current flow of the output 54 will identify the failed contact.

Referring to FIGS. 5 and 6 there is illustrated a rotary switch 110 incorporating longitudinally offset fingers 128 according to a second embodiment of the present invention. The second embodiment differs from the first with respect to the arrangement of the conductive fingers and protrusions.

In the second embodiment the rotary switch 110 consists of a conductive rotor 112 supported by a conductive shaft 116 within a frame 114 for rotation therein. A conductive finger 118 is preloaded to remain in contact with the conductive shaft 116. The conductive finger 118 is in electrical communication with a deicing power source (not shown), thus providing power to the conductive rotor 112 as it rotates. A stepper motor 120 is connected to an opposite end 122 of conductive shaft 116 for positioning the conductive rotor 112. Other means of positioning the rotary shaft 112 may also be used, such as a inductive switch and gear arrangement.

The conductive protrusions 124 are located on an outer surface 126 of conductive rotor 112. Conductive fingers 128 are positioned relative to the conductive protrusions 124 and the conductive rotor 112 by frame 114 such that a conductive finger 128 makes electrical contact with a conductive protrusion 124 when a protrusion 124 is located proximate a finger 128. Power is provided to a heater (not shown) when the conductive finger 128 is in electrical contact with the conductive protrusion 124.

The rotary switch 10 as illustrated in FIGS. 5, 6 and 7 provides power to three heater for a helicopter rotor. The conductive fingers 128 are arranged in two redundant banks, a first bank 130 and a second bank 132 along the same side of frame 114. As illustrated the each bank 130 and 132 contains three conductive fingers 128.

The conductive protrusions are likewise arranged in two redundant banks, a first set 134 and a second set 136, as illustrated in FIG. 5, with first set 134 located on a first axial section 138 of conductive rotor 112 and second set 36 located on a second axial section 140 of rotor 112.

The conductive protrusion are located every 120° around the circumference of the conductive rotor 112 for a total of 6 conductive protrusions. The conductive protrusions 112 are further arranged such that there is a single protrusion circumferentially aligned with each finger 128. These conductive protrusions 124 are further arranged such that there are two protrusions longitudinally aligned along the surface 126 in parallel with shaft 116. Therefore, with the conductive rotor 112 in a first position as shown in FIGS. 5, 6 and 7, conductive fingers 142 make electrical contact with conductive protrusions 144 thus providing power to a first heater zone of a helicopter rotor through two redundant contacts 156.

The electrical schematic of the subject invention according to the second embodiment is depicted in FIG. 7. The conductive rotor 112 is shown with first bank of conductive fingers 130 and a first set of conductive protrusions 136, a second bank of conductive fingers 132 and a second set of conductive protrusions 134. A pair of conductive fingers 142 is shown in contact with a pair of conductive protrusions 144, thus providing power to a heater. As the conductive rotor rotates a second pair of conductive fingers 146 will make contact with a second pair of conductive protrusions 148. Each pair of conductive fingers 142, 146 is connected to a respective heater by equivalent resistance wire 150. The wire 150 is connected to the heater via a current transformer 152. The wire 150 from each finger 128 of the pair of fingers 142, 146 is connected to the current transformer 152 such that when current is present in each wire 150, the current output 154 is zero. If either finger 128 of a pair of fingers 142, 146 fails to make contact with their respective conductive protrusion 144, 148, the current output 154 will no longer be zero, indicating a failure of one of the redundant pair of contacts 156. The direction of current flow of the output 154 will identify the failed contact.

The present invention has the advantage of providing redundant switching of power to heaters of a propeller rotor for deicing said rotor.

The present invention has the further utility of providing a warning that one switch of the redundant pair has failed.

The present invention has the further utility of identifying the failed contact.

It should be understood by those skilled in the art that obvious structural modifications can be made without departing from the spirit of the invention. Accordingly, reference should be made primarily to the accompanying claims, rather than the foregoing specification, to determine the scope of the invention.

We claim:

1. A rotary switch assembly for providing power to a load, the rotary switch including a conductive rotor, a conductive input means for providing power to the conductive rotor, the rotary switch assembly comprising:

a first contact means for transferring power from the conductive rotor to the load, said first contact means corresponding to a first position; and a second contact means for transferring power from the rotor to the load said second contact means corresponding to said first position wherein said first and second contact means transfer power to the load when the rotor in said first position.

2. The rotary switch assembly of claim 1 wherein said first contact means comprises:

a first conductive protrusion in electrical communication with the conductive rotor; and a first conductive finger in electrical communication with the load wherein said first conductive protrusion is placed in electrical communication with said first conductive protrusion when the conductive rotor is in said first position.

3. The rotary switch assembly of claim 1 wherein said second contact means comprises:

a second conductive protrusion in electrical communication with the conductive rotor; and a second conductive finger in electrical communication with the load wherein said second conductive protrusion is placed in electrical communication with said second conductive finger when the conductive rotor is in said first position.

4. The rotary switch of claim 1 further comprising:

a power sensing means for sensing said transfer of power from said first contact means and said second contact means wherein said power sensing means provides a fault indication if either said first or said second contact means fails to transfer power to the load.

5. The rotary switch of claim 4 further wherein said power sensing means is a current transformer.

6. The rotary switch of claim 5 further comprising:

a first wire connecting said first conductive finger to the load, wherein said first wire passes a first current through said current transformer in a first direction; and a second wire connecting said second conductive finger to the load, wherein said second wire passes a second current through said current transformer means in a second direction.

7. The rotary switch of claim 6 wherein said first direction is opposite said second direction such that there is no output from said current transformer said first and second contacts are functioning properly.

8. The rotary switch of claim 5 further comprising a third wire passing through said current transformer wherein said wire is periodically energized to test said current transformer.

9. A rotary switch assembly for providing power to a load, the rotary switch including a conductive rotor, a conductive input means for providing power to the conductive rotor, a frame for mounting the conductive rotor therein, the rotary switch assembly comprising:

a first conductive protrusion located on a surface of the conductive rotor;

a second conductive protrusion located on said surface of the conductive rotor;

a first conductive finger mounted to the frame, said first conductive finger in electrical communication with the load;

a second conductive finger mounted to the frame, said second conductive finger in electrical communication with the load, wherein when the conductive rotor is in a first position said first conductive protrusion is in electrical communication with said first conductive finger and said second conductive protrusion is in electrical communication with said second conductive finger such that power is provided to the load.

* * * * *